United States Patent [19]

Higgins

[11] 4,140,038

[45] Feb. 20, 1979

[54] FLUID JET CUTTER

[75] Inventor: Bobby L. Higgins, Dallas, Tex.

[73] Assignee: Camsco, Inc., Richardson, Tex.

[21] Appl. No.: 758,368

[22] Filed: Jan. 11, 1977

[51] Int. Cl.[2] ..... B26F 3/00; D06H 7/00

[52] U.S. Cl. ..... 83/177; 83/925 CC

[58] Field of Search ..... 83/53, 177, 513, 517, 83/925 CC; 266/50, 52, 58, 59

[56] References Cited

U.S. PATENT DOCUMENTS

| | | | |
|---|---|---|---|
| 2,336,596 | 12/1943 | Chouinard | 266/67 X |
| 2,345,314 | 3/1944 | Anderson | 266/50 X |
| 3,228,671 | 1/1966 | Lyons | 266/59 X |
| 3,492,552 | 1/1970 | Usami et al. | 266/59 X |
| 3,591,157 | 7/1971 | Culp | 266/59 |
| 3,620,521 | 11/1971 | Lundberg | 266/59 |
| 3,866,892 | 2/1975 | Hooper | 266/58 |
| 3,929,324 | 12/1975 | Lotz | 266/50 X |
| 3,978,748 | 9/1976 | Leslie et al. | 83/177 X |
| 4,007,652 | 2/1977 | Shinomiya et al. | 83/177 X |
| 4,048,885 | 9/1977 | Miyakita | 83/177 |

*Primary Examiner*—J. M. Meister

*Attorney, Agent, or Firm*—Sughrue, Rothwell, Mion, Zinn and Macpeak

[57] ABSTRACT

A fluid jet cutter utilizing a multitude of heads and flexible pressurized feed system is disclosed. The cutter utilizes a carriage which has mounted on it a plurality of fluid jet cutting heads which are maintained in registration with jet catchers operably disposed beneath the carriage. The cutters and jet catchers are movable either as a unit in synchronization with each other or moved separately to be spaced apart from a center head. Cutting in the Y-direction is effectuated by means of head movement along the carriage. Cutting action in the X-direction can be effectuated either by movement of the carriage or, alternatively, by movement of the cutting table bed. A tower disposed outside the cutting area is used to provide high pressure fluid to the cutting heads. The tower, with its flexible coupling, reduces the dynamic loads on the positioning system for the cutter heads, thereby allowing increased performance. Coverage of the full cutting area is effectuated by use of an overhead boom configuration coupled with a helical coil capable of extending and bending during motion of the carriage.

18 Claims, 8 Drawing Figures

FLUID JET CUTTER

BACKGROUND OF THE INVENTION

1. Field of the Invention

This invention relates to fluid jet cutting systems.

2. Prior Art

Within the prior art a number of devices and methods utilizing high velocity fluid cutting jets are known. This prior art may be divided roughly into several general categories. The first category generally concerns itself with experimental techniques directed toward establishing a proof of concept of the high velocity fluid jet technique. As found in *Machine Design*, on pages 89–93, of Feb. 22, 1973, these techniques generally involve pressurizing a working fluid which is subsequently ejected using a high velocity discharge nozzle. Several relatively early U.S. Pat. Nos. 2,985,050 and 3,212,378, are representative of prior art experimental devices. The lack of commercial success of these devices is generally attributed to the problem of dispersion of the working fluid upon ejection from the nozzle. This has resulted in poor or irregular penetration of cutting along the prescribed path and, additionally, tends to wet the surface. In view of these general problems, prior art fluid jet cutters have been used for cutting rough materials, such as ceramics, metal, lumber and the like.

Additionally, in order to shape or maintain the fluid flow, the prior art demonstrates basic research into the use of additives in the fluid. The use of such additives has been attempted as a means of overcoming the problem of wetting in high velocity systems. U.S. Pat. No. 3,136,649 shows the use of a reinforcing material such as a hardenable resin to support the edges of a cut in a perforating system, and U.S. Pat. No. 3,524,367 utilizes a long chain polymer as an additive to the fluid to increase cohesiveness and minimize dispersion of the fluid upon exiting from the jet. A variation is shown in U.S. Pat. No. 3,532,014 where the cutting rate of the fluid is optimized to volatilize the retained fluid in the edges of the cut by heat due to the frictional engagement of the material with the liquid jet. Such a system, while providing a solution to the problem of wetting, results in materially lower cutting rates and a general inability to cut multiple layers of material.

A second category of prior art centers about attempts to bring this basic research to the point of commercialization with conceptualized systems or components. Typical attempts are shown in U.S. Pat. No. 3,370,040 in which a proposed fluid jet catcher is disclosed. Since the fluid jet, once the cutting area has been traversed, still contains considerable energy, some technique or means must be provided for receiving that jet and effectively dispersing it without the problems of splashback or destruction of the device itself. The Chadwich et al U.S. Pat. No.(3,730,040) is one such prior art attempt at solving the problem of catching the fluid. Similarly, U.S. Pat. No. 3,625,813 discloses the use of a fluid jet cutter for making cuts in paper webs. As previously disclosed, very coarse cuts are made in the loosely matted material, and the jet may be selectively moved across the cutting surface as the material moves past it in an orthogonal direction.

Another attempt at defining a complete system is found in U.S. Pat. No. 3,877,334. This patent builds on basic cutter blade or knife edge technology by utilizing a vacuum chamber underneath the cutting table to position and hold the material. The problem of dispersion of the cutting fluid itself selectively, either by utilizing a honeycombed grid or a generalized porous bed, or as shown in FIG. 4 of that reference, the use of movable belts with the jet constrained to move in one direction and a trough disposed between the belts for receiving the fluid jet once it has exited the cutting surface. In the Gerber U.S. Pat. No.(3,877,334), basic techniques such as X - Y positioning are shown coupled together with the maintenance of a vacuum underneath the cutting table to position the material to be cut. None of these systems has been brought to the point of commercial application.

The third category of prior art deals with systems which have reached the point of commercial implementation and have been used in actual production. U.S. Pat. No. 3,978,784 (assigned to the same company as the present application) defines a commercially successful technique utilizing X - Y positioning controlled by computer and a fluid jet cutter slaved to the movement of the cutting head for movement with the carriage and the cutter, thereby maintaining registration to receive and disperse the fluid which is dispelled once it has passed through the cutting table. The Leslie and Higgins patent utilizes an arm with two segments, shown best in FIG. 5, which contain convoluted steel tubing to form torsional springs at the pivot points. The use of such arms provides a means for bringing high pressure water to the cutting head 44, yet allowing movement of the arms such that it can facilitate traversal of the entire cutting surface 20 by the carriage. This present application builds on the teachings of the Leslie and Higgins invention by providing material improvements in two distinct areas, fluid handling to the cutting heads and increased flexibility in production by using a multiple head arrangement.

SUMMARY OF THE INVENTION

The prior art devices, including those which have reached the stage of commercialization, are generally constrained in several areas. These devices all use a single cutting head which traverses the cutting path in some X-Y combination to effectuate cutting in the desired pattern. While the cutting rate is a function of machine design and computerized coordinate plotting techniques, the prior art has not been able to optimize such systems for increased cutting. Because the cutting tables are relatively large vis-a-vis the cutting path defined by a single head, maximization of throughput is generally a function of cutter speed. If the ability of a fluid jet cutter can be increased at the point of cutting, then the entire efficiency of the system is enhanced. This invention provides one significant advance over the prior art in terms of maximizing this throughout by utilizing a plurality of cutting heads disposed on the carriage. A central head is driven along the carriage and carries with it two auxiliary or slave cutting heads. A common source of fluid input is provided at the central head, and by means of manifold techniques, it is distributed to the three cutters. The two slave or auxiliary heads may be driven either in synchronism with the central cutter or can be spaced apart from it. Spacing and driving of each head is controlled by computer, utilizing well known X-Y positioning techniques. A general systematic configuration is shown in U.S. Pat. No. 3,978,748 and need not be described in detail herein. Disposed in operative alignment with each cutting head is a jet catcher. The jet catcher is slaved for movement with its associated cutting head utilizing techniques described in the above-referenced patent. By use of multiple cutting head techniques, throughput at the cutting station is increased, and the overall efficiency of the system enhanced.

This invention also utilizes advanced fluidic techniques to provide a source of high pressure driving fluid to the cutter heads. Within the prior art, problems of inertial loading on the carriage as a result of arm dynamics have been commonplace. In the Gerber U.S. Pat. No. 3,877,334, relatively moderate pressure fluid is delivered to the carriage through conduit 52 and an intensifier 54 is located on the carriage itself. The purpose of the intensifier is to boost the fluid to a nozzle pressure in the range of 10,000 to 100,000 psi. Accordingly, the Gerber patent recognizes that given the state of the art at the time of that invention, it was impossible to have a direct tubular couple utilizing high pressure from an intensifier to a nozzle without severe stress problems, and attempted to overcome the problem by means of locating the intensifier on the carriage. Such a system has the obvious disadvantage of increasing the weight of the elements on the carriage which must be driven, thereby adding significantly to the driving requirements of any motor system and the attendant problems of accelerating, decelerating and dealing with the resultant momentum of any such mass which must be driven in an environment which requires high accuracy. In the Leslie et al U.S. Pat. No. 3,978,748, the problem of mass and multiplicity of elements on the carriage has been solved by locating the intensifier at a position remote to the carriage and utilizing a flexible segmented arm system shown in FIG. 5 of that patent. Such a system presented problems of inertial loadings on the positioning system when the arm was in certain orientations. For example, when the arm was in a folded position, rapid position changes could not be easily effectuated, thereby degrading overall system performance. Hence, while such a system had generally proven satisfactory, it was unduly complicated and still was of considerable size and weight, that size and weight having to be moved with the carriage as that element traversed the cutting surface.

Accordingly, this invention solves the problem of providing a convenient, inexpensive and reliable technique for transporting high-pressure fluid to the cutter nozzles by the use of an overhead tower and boom arrangement which is positioned in the center of the cutting area. By use of a convolution of stainless steel, which is capable of extending and bending during the motion of the carriage, the problem of overstressing any part of the water feed mechanism is efficiently alleviated. Additionally, since such a coil acts merely as a spring element and is supported by the tower, the problem of introducing large forces into the cutter positioning system which were attendant in the prior art are completely eliminated.

Accordingly, it is an object of this invention to provide for an improved fluid jet cutting system.

Additionally, it is an object of this invention to provide a system whereby multiple cutting heads are utilized to effectuate multiple simultaneous cuts.

It is another object of this invention to provide a system whereby an improved fluid handling system is utilized to transmit high pressure fluid from an intensifier to the cutting heads.

A still further object of this invention is to provide for a system of high velocity liquid jet cutting utilizing techniques to vary the cutter head above the surface of the material and to vary the spacing of the cutter heads.

It is a still further object of this invention to provide a high velocity liquid cutting system that is fast, accurate and maximizes system throughput.

These and other objects of this invention will become apparent to those skilled in the art by reference to the following description and drawings.

DESCRIPTION OF THE PREFERRED EMBODIMENT

Figure 1:
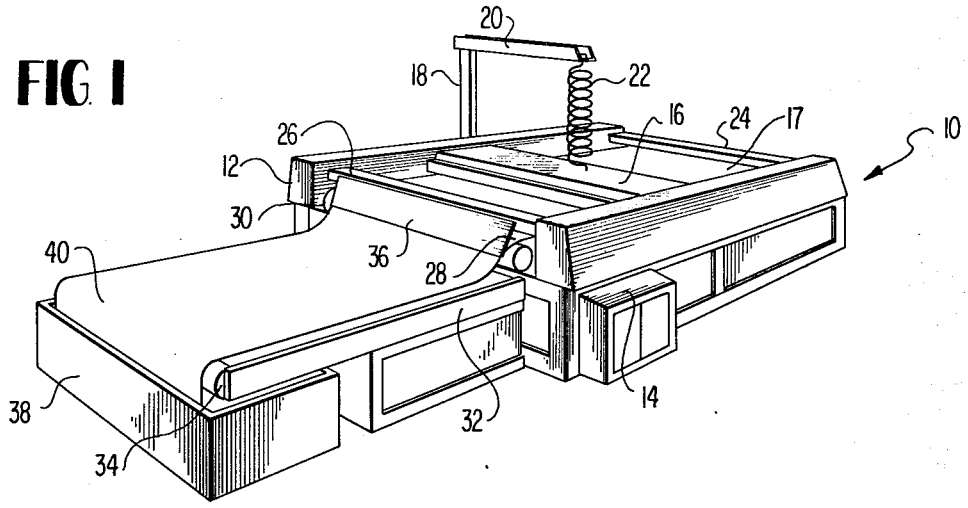
FIG. 1 is a functional perspective view of the overall fluid jet cutting system.

Referring now to FIG. 1, the overall fluid jet cutting system is shown as element 10. In its basic form, the system 10 comprises a cutting table 12 which has an electronics bay and operator's console 14 disposed on one side. The electronics bay and operator's console 14 contain within it all of the necessary controls to effectuate operation of the system. Although not shown, controls such as start-stop, manual overrides, and the like are provided.

The cutting table 12 has disposed on it a carriage 16 which contains the cutter heads. The carriage traverses the cutting table in the X-direction, while the heads move along the carriage in the Y-direction. Alternatively, although not shown, the carriage 16 may be placed in a fixed position, and utilizing conventional, well known material handling techniques, material may be advanced along the cutting table to provide directional movement in the X-direction.

High intensity cutting fluid, typically water, at a pressure in the range of 60,000 psi is provided from an intensifier at a remote point to the carriage by means of a water tower 18. Operably coupled to this tower is a tower arm or boom 20 which is allowed to rotate about the axis of the tower 18. The tower 18 is operably fixed to the cutting table 12 at a position which allows the boom to freely swing over the entire cutting surface. Coupling the tower arm 20 to the carriage 16 is a water feed coil 22. This water feed coil may be conventionally fashioned from stainless steel and is formed in approximately an 8" diameter coil. The functioning of this mechanism will be defined in greater detail herein.

Disposed at each end of the cutter table are conveyor clamps 24 and 26. Material is fed through clamp 24 onto the cutting table by means of a belt support bed 17, and when a preset amount of material has traversed the cutting table, the belt movement is terminated and clamps 24 and 26 are actuated to lock that material and the belt into position. The cutting operation then takes place over that raw material, and when complete, the clamps 24 and 26 are released to facilitate the removal of cut goods to the off load table 32, while at the same time allowing a new section of raw material to be advanced to the cutting table.

A conveyor 28 is used to guide the cut materials to the off load table 32 and utilizes a cutter conveyor drive roller 30. Obviously, well known techniques of material handling may be used in place of the belt support bed and clamp arrangement. This technique is, however, well suited to computer controlled operation.

An off load conveyor 34 is used to selectively gate the cut material 40 such that an operator disposed at the off load table can remove the cut material while scrap is placed into a scrap bin 38 as a result of the action of off load conveyor 34. Optionally, a safety shield 36 may be placed at the exit station to insure that personnel are physically isolated from the clamps.

Figure 2:
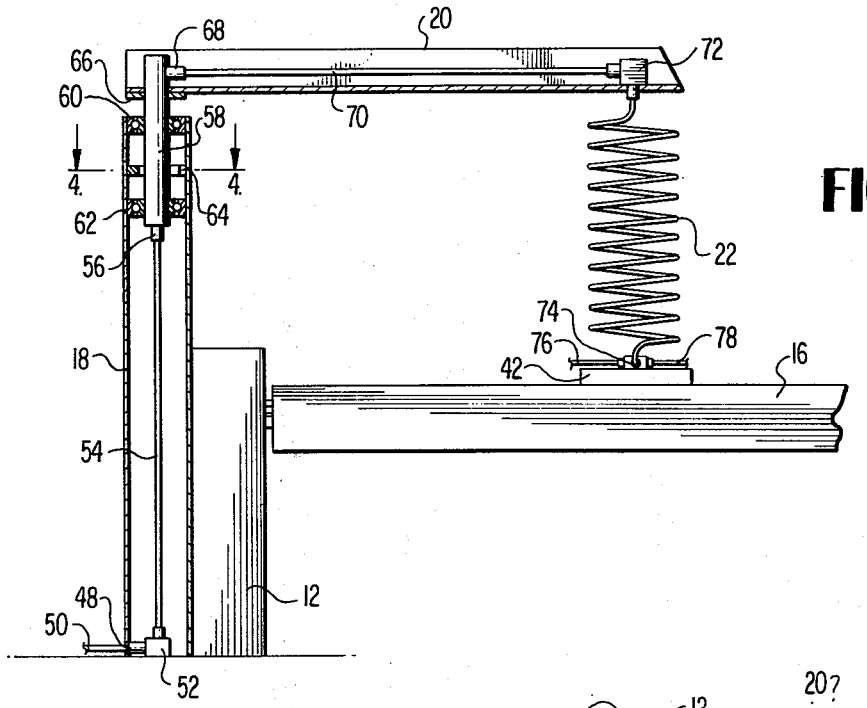
FIG. 2 is a side cut-away view of the fluid jet water feed tower.

Referring now to FIG. 2, a cut-away cross-section of the details of the water tower 18 and the tower arm 20 are shown. As shown in FIG. 2, the tower 18 is fashioned adjacent to and is made an integral part of the cutting table 12 and is a generally hollow box-like structure. In addition to housing the structure for conveying the high pressure fluid to the carriage, the tower 18 also is used to serve as the routing means for the hydraulics used for the cutter head valves and selected electronic components. Disposed at a convenient place in the tower 18 is an opening 48 which is used to provide an entry for the water intake 50. While shown in FIG. 2 as being disposed at the bottom of the tower 18, this intake can be placed at any convenient location. A high pressure coupling 52 is used to couple the water intake 50 to an elongate section of high pressure tubing 54. The section of tubing 54 must be long enough to accommodate the torsion in the system due to movement of the arm 20. This high pressure tubing is conventionally fashioned out of stainless steel which can accommodate this torsional twisting over its entire length.

Figure 4:
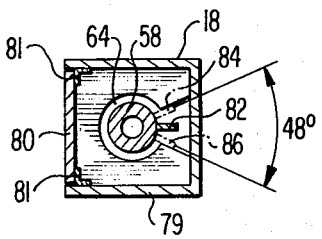
FIG. 4 is a top cut-away view of the tower along section 4—4 in FIG. 2.

Coupling 56 is utilized to link the tubing section 54 to manifold 58. Manifold 58 serves as an arm support for the arm 20 in bearings 60 and 62. Rotational stops 64, shown in greater detail in FIG. 4, are used to limit the travel of arm 20.

A high pressure coupling 68 is used to couple the manifold 58 to another elongate section of tubing 70 within the tower arm or boom 20. An arm coupling reinforcement 66 is utilized to provide additional strength at the point of cantilever of the tower arm. The section of tubing 70 is used in the water tower arm and is unloaded, in the sense that it carries no torsional loads. Those loads are carried completely by the section 54 and the helical or spring-like section of tubing 22.

As indicated herein, the tower 18 carries within it, in addition to the fluid supply, the electrical cabling used for the sensing and positioning system of the cutter heads. Additionally, the pneumatic lines for the clamps and the air sensor used in the Z-axis control of the cutter heads is also carried by the tower 18. Moreover, hydraulic lines for on-off valves are carried in this tower arm, as well as drainage lines for this hydraulic system. At the base of the tower 8, all regulators and valves associated with these subsystems are used. Accordingly, it can readily be appreciated that the tower arm 18 and the boom 20 provide a convenient technique for supplying the cutting table carriage 16 with all inputs needed to effectuate complete operation. Moreover, because these lines are carried overhead and are then suspended over the carriage, the torsional stress and weight requirements are materially reduced in the system.

Coupling the water transfer line 70 to the water feed coil 22 is a coupling 72. A manifold 74, located on the carriage, is used to distribute this source of high pressure water from coil 22 to each of the cutting heads on the carriage. While shown in this preferred embodiment as comprising three heads, it is readily understood that any number can conveniently be used. One such head 42 is shown schematically as resting underneath the manifold 74. Water feed lines 76 and 78 to the other heads, not shown, are used as shown in FIG. 2 as being effectively coupled to the manifold 74.

Figure 3:
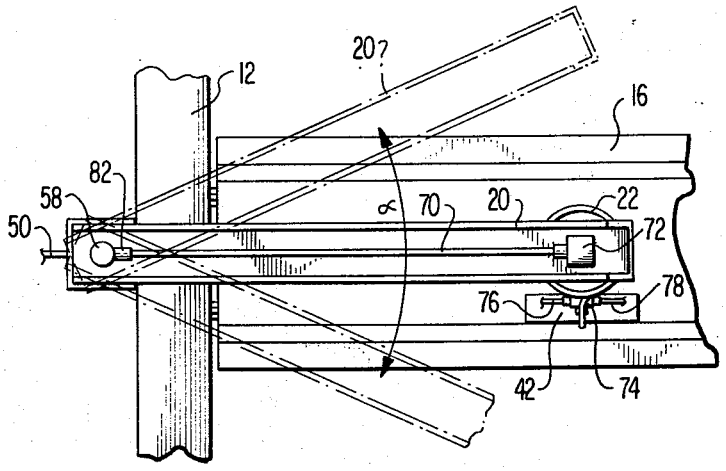
FIG. 3 is a top view of the water feed tower showing the angle of movement of the boom.

Referring now to FIG. 3, the excursion of the boom arm is shown. FIG. 3 is a schematic top view of FIG. 2 which shows the arm 20 in a center position which corresponds to the midpoint of the motion of the carriage 16 along the X-axis on the table. Schematic functional elements of the carriage 16 are shown. The arm 20, as shown in the broken lines, has an excursion angle $\alpha$. This angle is generally approximately plus-minus 24° from center giving a total angular limit of 48° of travel. This angle may vary depending on particular applications and the size of the cutting head; however, it has been found through experimentation that the 48° swing is most expedient for a cutting area of 72" in the X- and 64" in the Y-directions.

Referring now to FIG. 4, a cutaway section of the tower 18 taken along section line 4—4 in FIG. 2 is shown. As shown in FIG. 4, the tower 18 comprises a generally U-shaped assembly 79 which may be fashioned out of steel or the like. An end plate 80 is located in a contiguous arrangement with the U-shaped assembly 79 and is supported by means of angle brackets 81. The brackets 81 are welded on one side to the U-shaped assembly 79 and provide a support for the end plate 80. This end plate or tower cover provides access to the entire tower and may be removed.

Shown in detail in FIG. 4 is the mechanical technique used to provide the limits or stops for the excursion of the arm 20. The rotational stop 64 has disposed on it two limiters 84 and 86 which mechanically limit the excursion travel of the manifold 58. The manifold 58 has disposed thereon a projection or tab 82 which, when abutting against the stops 84, 86, effectively defines the excursion or limits of travel of the tower 20. It is readily apparent that this mechanical technique is only one of a number of alternatives, and, for example, a block on the manifold itself could be used to provide limits of travel. Additionally, although not shown, some form of viscous damping can be used to remove any sudden accelerations or decelerations from the system.

Referring now to FIGS. 5 through 8, the details of the carriage assembly showing the operative subsystems of this invention are shown. These subsystems can be broken down into various functional levels for purposes of elaboration. As shown in those figures, high pressure water from the tower 18 through boom arm 20 is conveyed to the manifold 74 through water feed coil 22. The manifold 74 is fixed to the carriage by bracket 74 which couples the manifold to the bearing retainer 112. As shown best in FIGS. 5 and 7, the manifold 74 has a first water feed coil to the central nozzle 42. This feed coil is convoluted into a first section 88 and a second looped section 89 which facilitates the motion of the nozzle head in the Z-axis. Accordingly, as the nozzle 42 moves up and down, the coils 88 and 89 facilitate that motion without placing any excessive loadings on the system.

Figure 5:
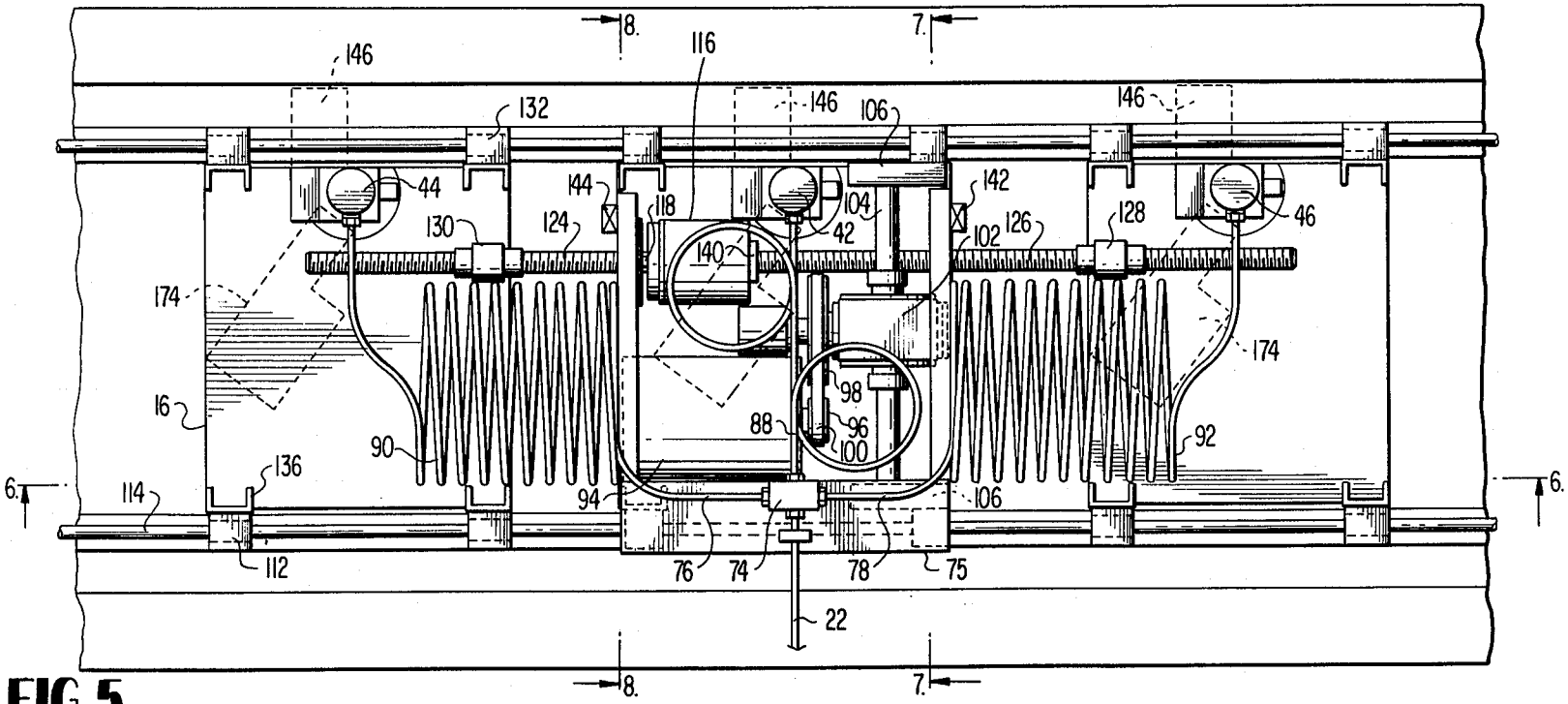
FIG. 5 is a top view of the carriage assembly showing the main cutting head drive and the secondary drive assemblies.
Figure 6:
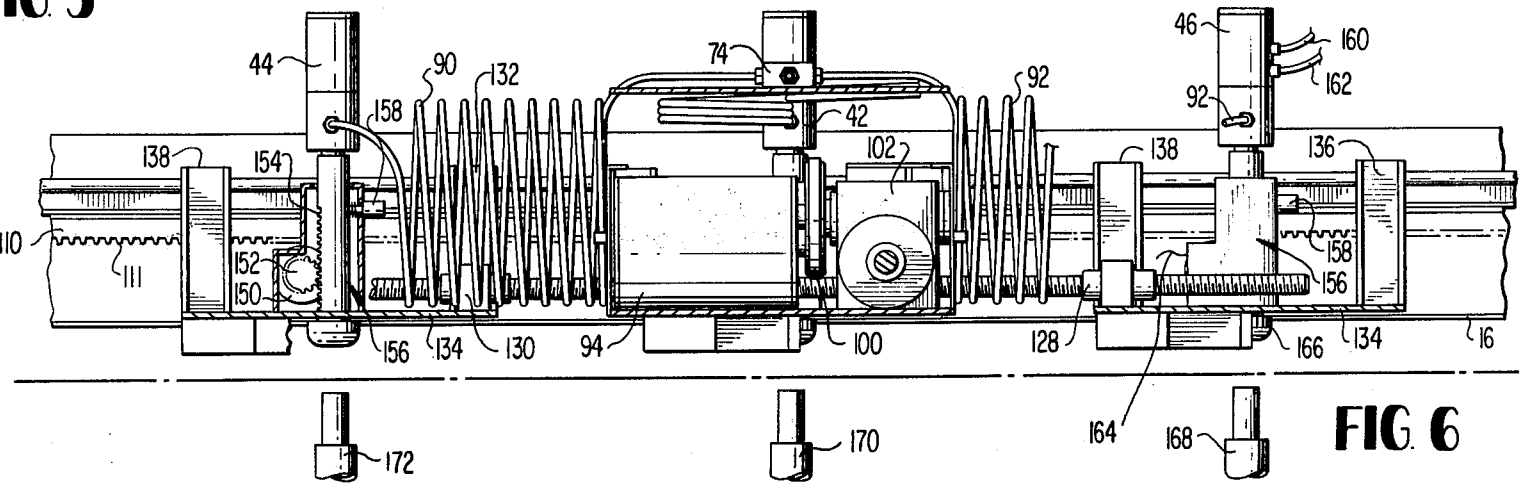
FIG. 6 is a cut-away side view of the carriage assembly showing the cutter head positioning elements and water feed components.

As shown in FIGS. 5 and 6, two satellite feed lines 90 and 92 branch from the manifold 74 to the slave heads 44 and 46. For purposes of illustration, the slave head 46, as best shown in FIG. 6, can be broken down to show the details of that construction.

The cutter head 46 receives input from the coil 92, thereby supplying it with water under pressure. A cutter nozzle 166 is disposed for movement on the underside of the carriage 16 and has adjacent to it a jet catcher 168. Jet catchers 170 and 172 are shown positioned adjacent to the remaining two cutting heads. These jet catchers are slaved for motion to maintain registration with each cutting head irrespective of the motions of those heads. Hence, as the slave heads 44 and 46 are spaced away from the central cutting head 42, the jet catchers 168 and 172 will move a corresponding distance to maintain registration with the respective heads. Also, as the entire assembly traverses along the carriage, the three jet catchers will move in a corresponding direction in the Y-axis to maintain complete registration with each head.

Figure 8:
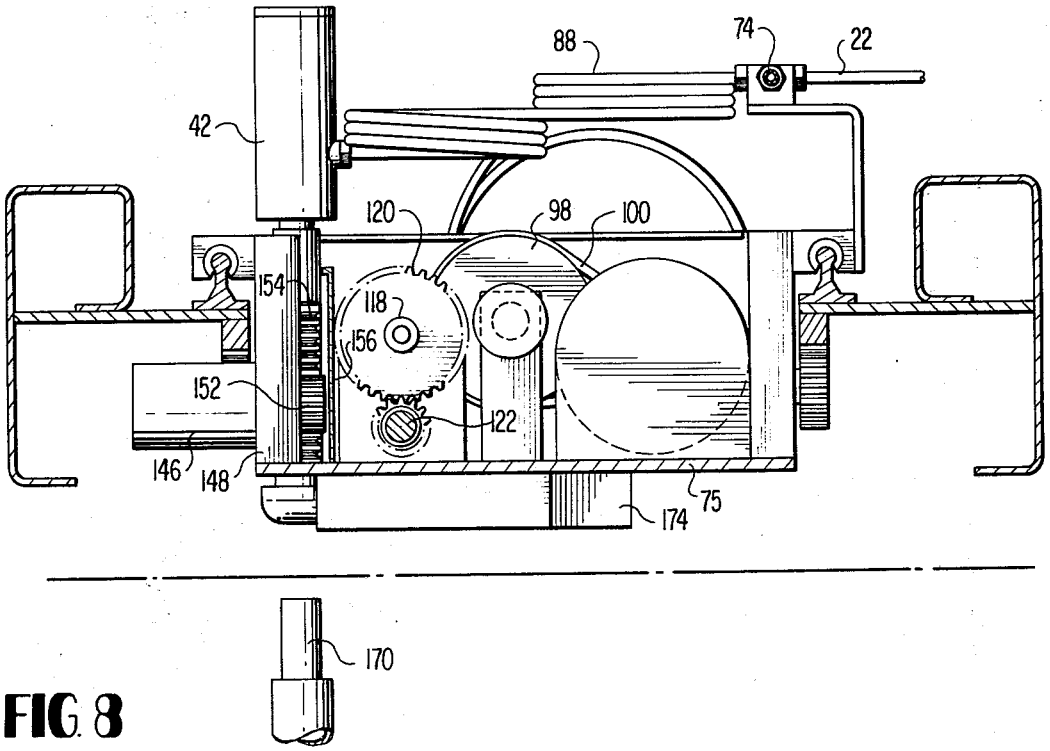
FIG. 8 is a cut-away end view of the positioning elements used to separate the ancillary cutter heads taken along section 8—8 in FIG. 5.

Referring again to the details of the slave head 46, shown in FIG. 6, a first hydraulic line 160 is shown which provides high pressure hydraulic fluid for the system. A return line 162 is shown schematically, as well as an electrical coupling providing the necessary electronics for the Z-axis positioning via line 164. As shown in FIG. 8, a Z-axis drive motor 146 is mounted on a plate which comprises part of the housing for the nozzle and comprises an enclosure assembly 156. The Z-axis drive motor 146 is directly coupled to a drive pinion 152 that is operably engaged with the Z-axis rack 154. By selective actuation of the motor 146, the drive pinion 152 is rotated in either the clockwise or counterclockwise direction to effectuate an up and down movement of the cutting head 166 as a result of interaction of the pinion 152 on the rack 154. A brake 158, generally comprising a spring loaded solenoid, is used to lock the nozzle in position when there is no Z-axis movement. When the Z-axis drive motor 146 is actuated, the brake is released to facilitate such motion, and when the motor is off, the brake is turned on to lock the nozzle in position.

Figure 7:
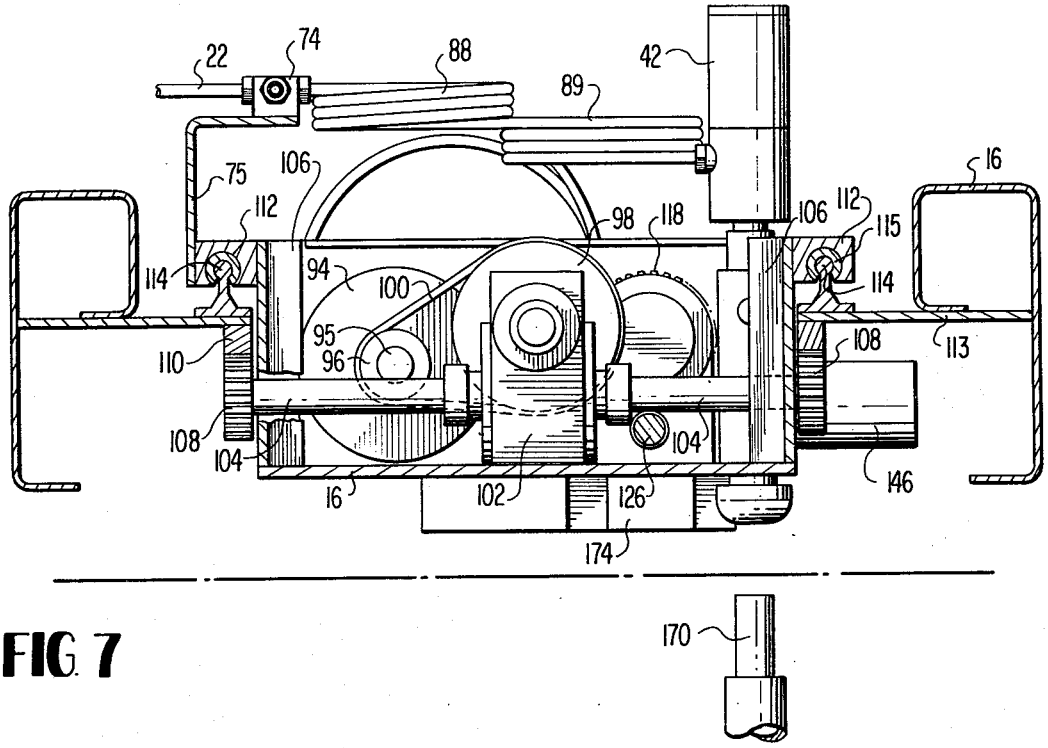
FIG. 7 is a cut-away end view of the drive positioning assembly taken along section 7—7 in FIG. 5.

Referring now to FIGS. 5 and 7, the details of the Y-axis drive motor are shown. A primary Y-axis drive 94 typically comprises a DC servomotor. The output of motor 94 via shaft 95 is transmitted by pulley 96 to pulley 98 via belt 100. A transmission unit 102 receives the output from DC motor 94 and converts it for motion in the Y-direction. It is readily apparent that the output of the Y-axis drive motor 94 could be transmitted for motion by means of a unified gear system in place of the pulley, drive belt transmission arrangement shown. The output of transmission 102 is the drive shaft 104, best shown in FIG. 7, which is constructed as an anti-backlash shaft arrangement. Bearings supporting this drive shaft are housed in members 106 shown in FIG. 7. A drive pinion 108 coupled to shaft 104 drives the unit along rack 110.

As shown in FIG. 7, the drive rack is fixedly coupled to the cutting table frame 12 by means of a rigid member 113 upon which a rail 114 stands. A bearing retainer 112 is used to support on bearing 115 the carriage on the rail 114. The drive rack 110 is shown also in FIG. 6 which schematically shows a portion of the teeth 111 on that rack. Accordingly, it can be seen from the figures that as drive motor 94 is actuated, the direction of motion of the output shaft on the motor will reversibly drive the pulleys 96 and 98 through a transmission 102 to actuate the drive pinions 108 in such a manner that the entire carriage will traverse the table along rails 114. The carriage 16 also has disposed on it at various places additional bearings and supports 136 and 138 to completely support the carriage. As shown in FIG. 6, satellite plates 134 are used to support the slave units 44 and 46 on the carriage. By this technique, the entire head assemblies are moved in the Y-direction in a unified manner.

Motion in the X-direction, that is, motion of the carriage 16 along the length of the cutting table, is supplied by an X-direction drive motor and rack and pinion arrangement, not shown, similar to the Y-axis system previously illustrated and described. Alternatively, movable bed arrangements can be utilized wherein the carriage 16 remains fixed on the cutting table, but the material is caused by means of roller arrangements to traverse under the carriage. A typically suitable arrangement is shown in U.S. Pat. No. 3,598,006, and in particular in FIG. 7 thereof. In such an arrangement, because of the necessity for maintaining movement and registration of the jet catchers, the space defined under the cutting table can be used to facilitate motion of those jet catchers as the material traverses over the table in the X-direction.

The details of the subsystem for achieving separation of the slave heads will now be described. As shown in FIGS. 5 and 6, the slave heads 44 and 46 are mounted on satellite plates denoted as elements 134. Slave cutting head 46 mounted on plate 134 is coupled to the carriage by supports 136 and 138 which ride on rail 114 via coupling to the bearing retainer 112.

The slave cutting heads 44 and 46 are moved equal increments in opposite directions as a function of the rotation of the split lead screw 124 and 126. A head separation stepper motor 116, shown in FIG. 5, has an output shaft 118, shown best in FIG. 8. Mounted on the output shaft 118 is a pinion 120 which operably engages a gear 122. Alternatively, an output pulley and timing belt system can be used. A right hand lead screw 124 and a left hand lead screw 126 are operably driven by the output of the gear mechanism from the stepper motor 116. Since the threads are posed on lead screw 124 vis-a-vis those on 126, output of the stepper motor 116 effectuates rotation in the same direction thereby resulting in opposite movement of the slave heads 44 and 46.

Rotation of the lead screw 126 is transmitted to a drive nut 128 operably fixed on plate 134 to effectuate movement of the slave cutting head 46. In a similar fashion, drive nut 130 mounted on plate 134 effectuates movement of the slave head 44.

A position resolver 140 operably coupled to the stepper motor is used to determine the extent of travel of the slave cutting heads. Two zero position limit switches 142 and 144 are used to provide an indication of the initial starting point of travel of the slave heads from the central head 42. Accordingly, it can be seen that as the stepper motor 116 is actuated, the slave heads 44 and 46 can be driven in equal increments away from the central cutting head 42 or brought closer together by equal increments. All motion on the carriage of the cutter heads is computer-controlled and monitored.

It is readily apparent that using such an arrangement throughput at the cutting station can be maximized by having three simultaneous cutting paths take place. Efficiency of operation is thereby materially enhanced since the cutting operation, normally the slowest point in machine utilization, is materially increased by a multiple number of heads.

It is readily apparent that various modifications to this system can be accomplished within the scope of this invention. For example, while three cutting heads are shown, a greater or lesser number can be accomplished utilizing the same basic techniques. Additionally, while the slave heads 44 and 46 are shown to be moving in equal opposite increments, it is apparent that they could be mechanically driven in the same direction, or in a more complicated arrangement, be driven independently by means of the use of a plurality of stepper motors. In the last-mentioned alternative, each stepper motor would be dedicated to movement of a single slave cutting head, and, accordingly, independent motions for each head can be effectuated in the Y-direction.

Positioned on the carriage 16 adjacent to each head is a device which is used to place labels on pieces after they have been cut. These labeler devices, shown schematically as elements 174, are positioned relative to each cutting head and are driven by computer control. Each labeler 174 contains within it a small printing mechanism used to imprint an identifying number on a small adhesive label. As each part is cut on the cutting table by the respective cutting head, the identifying number is printed under computer control and deposited by the labeler as the cut is completed. This label is placed on the cut part and adheres to it by means of a self-sticking adhesive on the label itself. Various techniques can be used to ensure that the label makes contact with the cut part, such as a small tamper solenoid driven from the labeler or the use of a small high pressure air jet used to provide a minimal amount of pressure differential to ensure the adhesive sticks to the cut part.

Other modifications can be made without departing from the essential features of this invention.

Having, therefore, described this invention, I claim:

1. A liquid jet cutting system for cutting a workpiece comprising:

a) means to support said workpiece in a stationary manner on a cutting table;

b) a carriage located on said table, said carriage movable in one axial direction;

c) at least one liquid jet cutting head located on said carriage, means on said carriage for moving said cutting heat in a direction orthogonal to the axis of direction of said carriage;

d) a source of liquid under pressure located at a position apart from said cutting table; and e) support means separated from said cutting table unsupported by said carriage and movable in response to movements of both said carriage and said cutting head; said support means including and supporting a pressure coupling to connect said source of liquid under pressure to said cutting head.

2. In a fluid jet cutting system having a source of fluid, a cutting tabel, a carriage disposed on said table and carrying thereon a movable cutting head to effectuate cuts of a workpiece, the improvement comprising: first fluid conveying means adjacent the table having an arm disposed for movement over said table said arm unsupported by said carriage, and second fluid conveying means coupled to both said arm and said cutting head, said second fluid conveying means being flexible and extensible to connect said source of fluid to said cutting head in a flexible manner.

3. The system of claim 2 wherein said first fluid conveying means comprises a tower disposed adjacent to said table and said arm is linked to the top of said tower by a manifold.

4. The system of claim 2 wherein said second fluid conveying means comprises a flexible helical coil.

5. A fluid jet cutting system for cutting a workpiece comprising:

a) means to support said workpiece in a stationary manner on a cutting table;

b) a carriage located on said table, said carriage movable in one axial direction;

c) at least one fluid jet cutting head located on said carriage, means on said carriage for moving said cutting head in a direction orthogonal to the axis of direction of said carriage;

d) a source of fluid under pressure located at a position apart from said cutting table; and e) support means separated from said cutting table unsupported by said carriage and movable in response to movements of both said carriage and said cutting head to couple said source of fluid to said cutting head, including a vertical tower disposed in proximity to the cutting table, a horizontal arm mounted for rotation on said tower and positioned above said cutting table, and flexible fluid conveying means disposed in said tower and adapted to flex in response to rotation of said arm.

6. The system of claim 5 including a flexible coil coupling said arm to said cutting jet.

7. The apparatus of claim 5 wherein said tower has disposed therein limit stops to inhibit rotation of said arm to within predetermined limits, and means coupled to said flexible fluid conveying means for contact with said limit stops.

8. The apparatus of claim 7 wherein said limit stops define an arc of rotation of said arm to 48°.

9. The apparatus of claim 7 wherein said flexible fluid conveying means is coupled to a manifold in said tower, said manifold extending into said arm and joined to it, wherein rotation of said arm in response to movement of said cutting jet causes rotation of said manifold.

10. The system of claim 9 wherein said manifold is located at one end of said tower, said source of fluid entering said tower at the opposite end thereof through a coupling and including an extended conduit joining said manifold to said coupling.

11. A liquid jet cutting system comprising: a source of liquid, a cutting table, a carriage disposed above said cutting table, at least three cutting heads located on said carriage, means coupling said cutting heads to said source of liquid, including a tower disposed adjacent to said table and having an arm movable over said table, and a flexible coil coupling said arm to a manifold, and means for driving two of said heads on said carriage relative to the third head.

12. The system of claim 11 including means to effectuate relative movement between said carriage and said cutting table.

13. The system of claim 12 including means to drive said three heads simultaneously in the same direction.

14. The system of claim 12 including means to drive two of said heads simultaneously in equal and opposite directions relative to said third head.

15. The system of claim 11 wherein said manifold is located on said carriage and further including helical coil means coupling said heads to said manifold.

16. A liquid jet cutting system for making multiple simultaneous cuts on a workpiece comprising:

a) a cutting table supporting said workpiece;

b) a carriage located on said cutting table, said carriage having a rail disposed thereon;

c) at least first and second liquid jet cutting heads disposed on said rail;

d) motor means to drive said cutting heads on said rail in the same direction simultaneously, comprising a direct current servo motor, output means on said motor and drive pinion coupled to said output means, a drive rack on said carriage whereby movement of said drive pinion relative to said rack moves said first and second heads on said rails;

e) motor means to drive at least one of said cutting heads on said rail independent from the other of said cutting heads, comprising a lead screw, means mounting said lead screw in a fixed relationship relative to the second of said heads, drive means coupling said first of said heads to said lead screw in a movable manner, and means to rotate said lead screw whereby rotation moves the first of said heads relative to the second cutting head;

f) a source of liquid under pressure and means providing liquid to said heads from said source; and g) means disposed under said carriage and movable with the carriage to catch liquid dispersed during cutting of said workpiece.

17. The system of claim 16 wherein said means to rotate said lead screw is a stepper motor.

18. A liquid jet cutting system for making multiple simultaneous cuts on a workpiece comprising:

a) a cutting table supporting said workpiece;

b) a carriage located on said cutting table, said carriage having a rail disposed thereon;

c) at least first, second and third liquid jet cutting heads disposed on said rail;

d) motor means to drive said cutting heads on said rail in the same direction simultaneously;

e) motor means to drive at least one of said cutting heads on said rail independent from the other of said cutting heads, said motor means including means to drive said first and third heads relative to said second cutting head, simultaneously in equal and opposite directions;

f) a source of liquid under pressure and means providing liquid to said heads from said source; and g) means disposed under said carriage and movable with the carriage to catch liquid dispersed during cutting of said workpiece.

* * * * *